US006236156B1

(12) United States Patent
Ito

(10) Patent No.: US 6,236,156 B1
(45) Date of Patent: May 22, 2001

(54) MICRO VACUUM PUMP FOR MAINTAINING HIGH DEGREE OF VACUUM AND APPARATUS INCLUDING THE SAME

(75) Inventor: Fuminori Ito, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/129,993

(22) Filed: Aug. 6, 1998

(30) Foreign Application Priority Data

Aug. 6, 1997 (JP) ..... 9-212076

(51) Int. Cl.[7] ..... H01J 1/62

(52) U.S. Cl. ..... 313/495; 313/309; 313/558; 315/169.3

(58) Field of Search ..... 313/495, 496, 313/309, 351, 336, 558, 481, 422; 315/169.3; 345/74, 75

(56) References Cited

U.S. PATENT DOCUMENTS

| | | | | |
|---|---|---|---|---|
| 5,585,689 | * | 12/1996 | Imura et al. | 313/336 |
| 5,621,273 | * | 4/1997 | Vrijssen | 313/479 |
| 5,637,958 | * | 6/1997 | Levine | 313/495 |
| 5,656,889 | * | 8/1997 | Niiyama et al. | 313/558 |
| 5,763,998 | * | 6/1998 | Colombo et al. | 313/309 |
| 5,814,931 | * | 9/1998 | Makishima | 313/309 |
| 5,969,467 | * | 10/1999 | Matsuno | 313/495 |
| 5,994,833 | * | 11/1999 | Seko et al. | 313/495 |

FOREIGN PATENT DOCUMENTS 7-29520 1/1995 (JP) .

7-18341 3/1995 (JP) .

OTHER PUBLICATIONS

Atsushi Koma, "Surface Physical Properties Engineering Handbook", Maruzen Co., Ltd., pp. 434–435 ©1987.

C.A. Spindt et al., "Physical Properties of Thin–Film Field Emission Cathodes with Molybdenum Cones", Journal of Applied Physics, vol. 47, No. 12, Dec. 1976, pp. 5248–5263.

* cited by examiner

*Primary Examiner*—Vip Patel
*Assistant Examiner*—Joseph Williams
(74) *Attorney, Agent, or Firm*—Young & Thompson

(57) ABSTRACT

The present invention provides a micro vacuum pump capable of enhancing the performance of exhausting rare gases as well as active gases thereby to ensure quality, good repeatability and stable getter action of the micro vacuum pump over a long time. The invention also provides an apparatus assembling the micro vacuum pump. The micro vacuum pump capable of maintaining a high degree of vacuum includes a first conductive substrate having many protrusions and mounting a second conductive substrate disposed with a predetermined interval provided with respect to the first conductive substrate so that it faces the protrusions. A gate electrode is disposed in the vicinity of the apexes of the protrusions on the first conductive substrate via an insulator layer, and is positioned to face the second conductive substrate. Relative to the first conductive substrate, a negative potential is supplied to the second conductive substrate, and, a same negative potential difference is also applied to the gate electrode relative to the cones.

16 Claims, 6 Drawing Sheets

MICRO VACUUM PUMP FOR MAINTAINING HIGH DEGREE OF VACUUM AND APPARATUS INCLUDING THE SAME

BACKGROUND OF THE INVENTION

1. Field of the Invention

The present invention relates to a micro vacuum pump for maintaining vacuum in a chamber and an apparatus including the same. And, more particularly, the present invention relates to a micro vacuum pump that is capable of maintaining a high degree of vacuum, enhancing exhaust performance, and securing quality over an extended period of time.

2. Description of Related Art

Most apparatuses requiring a vacuum environment employ diverse exhausting methods to enhance the degree of internal vacuum. For example, there are semiconductor manufacturing apparatuses incorporating deposition treatment units, dry etching units, etc., or surface observing apparatuses incorporating electron microscopes, etc. These apparatuses employ ion pumps or turbo-molecular pumps or other types of vacuum pumps that are large and provide high exhausting speed to exhaust the interior of the vacuum chambers of the apparatuses at all times thereby to maintain a high degree of vacuum.

Vacuum airtight apparatuses such as cathode ray tubes (CRTs) or flat panel displays do not carry out regular exhaust by large, expensive vacuum pumps because they are required to achieve reduced size and weight and lower cost. In the vacuum airtight apparatuses, getters composed of metal materials such as barium are activated in the vacuum chambers in the vacuum airtight apparatuses to adsorb residual gases so as to maintain substantially the vacuum.

In a CRT, which is one of those vacuum airtight apparatuses, a getter material placed in the tube is evaporated by external high-frequency induction heating or the like so that it adheres to the inner wall of the tube thereby to exhaust any gas in the tube. In this case, the getter material adhering to the inner wall of the tube is chemically active and adsorbs a residual gas, thus enhancing the vacuum in the tube. In a flat panel display also, the vacuum in the display is retained by the adsorption of a residual gas by a getter material as in the case of the CRT.

Hitherto, a micro vacuum pump adapted to secure vacuum in a vacuum chamber by such an exhausting method has been employing a getter device that has been disclosed under a title "GETTER DEVICE AND FLUORESCENT DISPLAY TUBE HAVING THE GETTER DEVICE" in Japanese Unexamined Patent Publication No. Hei 7-29520 (1995).

In the getter device proposed in the publication, protrusions or emitter cones 103 are disposed on a surface of a cathode electrode 102 opposed to a getter 101 so that they face against the getter 101 as shown in FIG. 1. The getter 101 is made of barium or other metal material. The emitter cones 103 are conical. A gate electrode 105 is mounted on a cathode electrode 102 via an insulator layer 104 and provides the surfaces opposed to the getter 101. The gate electrode 105 is provided with holes to be formed around the respective emitter cones 103. The insulator layer 104 also has holes. The gate electrode 105 provides driving forces for the emitter cones 103 to emit electrons.

In this constitution, relative to the cathode electrode 102, a positive potential differences Vp is supplied to the getter 101 serving as the anode and a positive potential differences Vg is supplied to the gate electrode 105. And an electric field is supplied to the emitter cones 103 on the cathode electrode 102. The emitter cone 103 to which the electric field has been supplied emits electrons passing through the hole of the gate electrode 105. The electrons collide against the getter 101 to activate the getter 101. The activated getter 101 develops enhanced reactivity to other atoms and adsorbs gaseous molecules that form the ambient residual gas. This enables the vacuum in the vacuum chamber to be maintained.

Another example that employs a micro vacuum pump is a vacuum airtight apparatus that has been disclosed under a title "VACUUM AIRTIGHT APPARATUS AND DISPLAY DEVICE" in Japanese Unexamined Utility Model Publication No. Hei 7-18341 (1995).

The vacuum airtight apparatus described in the publication is used for a display device that employs a field emission cathode. In this type of display device, an anode electrode 111 that provides a screen has a fluorescent surface 110 on the surface opposed to a cathode electrode 112 as shown in FIG. 2. Relative to the cathode electrode 112, a high potential difference Vp is supplied to the anode electrode 111. For this reason, electrons are emitted from a plurality of protrusions or emitter cones 113 provided to match the pixels on the cathode electrode 112. The emitted electrons pass holes of a gate electrode 115 and a focusing electrode 116 disposed via two insulator layers 114 and the focusing electrode 116 disposed near the anode electrode 111 before they reach the surface of the anode electrode 111. The focusing electrode 116 positioned in the vicinity of the anode electrode 111 is constituted by getter materials. The gate electrode 115 and the focusing electrode 116 are set at potential differences Vg1 and Vg2 respectively and have the almost same potential to that of the cathode electrode 112.

In this configuration, the electrons emitted from the emitter cones 113 collide against the surface of the anode electrode 111 and a gas is sputtered from the surface of the anode electrode 111. The sputtered and released gas has positive ionic molecules, so that it is effectively caught and collected by the focusing electrode 116 composed of the getter materials that have substantially the same potential as that of the cathode electrode 112. As a result, the residual gas present in the vacuum chamber can be efficiently captured as not to affect the electron emitting capability of the emitter cones 113.

In the conventional micro vacuum pumps described above, the getters are activated and the activated getters adsorb the gaseous molecules in the vacuum chamber. Hence, active gases including oxygen- and carbon-based gases can be adsorbed, however, inert gases including argon cannot be adsorbed.

Thus, there has been a problem in that the capability of exhausting rare gases, i.e. inert gases, is deteriorated and the quality and performance required of the vacuum pumps cannot be ensured. This means that unstable images, deteriorated luminance, or shorter service life has been observed when driving a CRT, flat panel display, or the like in such a vacuum environment.

Further, in the vicinity of the emitter cones or the protrusions, ionized residual gases such as argon having a high sputtering yield pour down on the negative-electrode protrusions and inevitably damage the protrusions that emit electrons in the getter device. This leads to marked deterioration in the electron emitting property and makes it difficult to retain stable gettering performance with good repeatability over a long period of time.

SUMMARY OF THE INVENTION

Accordingly, the present invention has been made with a view toward solving the problems described above. And it is an object thereof to provide a micro vacuum pump that ensures quality and good repeatability and maintains stable getter action over a prolonged period of time, and an apparatus assembling the same.

To this end, according to one aspect of the invention, there is provided a micro vacuum pump including a first conductive substrate that has many protrusions each of which has the identical form with the above emitter cone and a second conductive substrate disposed with a predetermined interval from the first conductive substrate so that it is opposed to the protrusions. A gate electrode is mounted via an insulator layer on the first conductive substrate and near the protrusions so that it is opposed to the second conductive substrate. A negative potential is supplied to the second conductive substrate, and a negative potential is supplied to the gate electrode, relatively to the protrusions or the first conductive substrate.

With this arrangement, an active gas and a rare gas are ionized in the vicinity of the protrusions of the first conductive substrate, and the ionized gases are caught by the second conductive substrate when the second conductive substrate has been activated.

In a preferred form of the invention, each of the protrusions of the micro vacuum pump is conical. Hence, a high level of electric field strength is generated at the apex portions of the protrusion that has a small radius of curvature.

In another preferred form of the invention, the second conductive substrate of the micro vacuum pump has many V-shaped grooves in the surface facing the gate electrode. Hence, the sputtering yield in the second conductive substrate increases with a resultant enhanced activation of the second conductive substrate.

In a further preferred form of the invention, in the micro vacuum pump, a negative electric field of $10^8$ V/cm or more is applied to the apex of the protrusions through holes in the gate electrode. Moreover, the negative electric field is set to not more than a level at which the protrusions are field-evaporated. Accordingly, the ionizing efficiency of a neutral gas can be improved without causing the field evaporation of the protrusions.

In yet another preferred form of the invention, relatively to the protrusions, a negative potential difference of 1 kV or more is supplied to the second conductive substrate in the micro vacuum pump. Hence, the number of ions collected by the second conductive substrate increases, and the sputtering of surface atoms activates the surface of the second conductive substrate.

According to another aspect of the invention, there is provided an apparatus assembling the micro vacuum pump in a vacuum chamber that has a vacuum airtight space formed therein. Hence, an active gas and a rare gas in the vacuum airtight space can be ionized in the vicinity of the protrusions of the first conductive substrate and the ionized gases can be caught and collected by the activated second conductive substrate.

In a preferred form of the invention, the apparatus assembling the micro vacuum pump is a flat panel display that has the vacuum airtight space. The image display section in the flat panel display is surrounded by the protrusions and the second conductive substrate in a plane. Accordingly, an active gas and a rare gas in the flat panel display can be ionized in the vicinity of the protrusions of the first conductive substrate and the ionized gases can be caught and collected by the activated second conductive substrate.

In a preferred form of the invention, the apparatus assembling the micro vacuum pump is a flat panel display having an image display assembly surrounded by the protrusions corresponding to a respective pixel and the second conductive substrate in the same plane. Hence, an active gas and a rare gas in the flat panel display can be ionized in the vicinity of the protrusions of the first conductive substrate and the ionized gases can be caught and collected even more efficiently by the activated second conductive substrate.

According to another aspect of the invention, the apparatus assembling the micro vacuum pump is a CRT that has the vacuum airtight space. The micro vacuum pump is connected via a conductor to an electrode terminal block at the neck of the CRT. Hence, an active gas and a rare gas in the CRT can be ionized in the vicinity of the protrusions of the first conductive substrate and the ionized gases can be caught and collected by the activated second conductive substrate.

According to yet another aspect of the invention, the apparatus assembling the micro vacuum pump is a CRT that has the vacuum airtight space and also has a field emission type cold cathode as an electron gun and a multi-stage electron lens system in the space. Relative to emitter electrodes, a negative potential difference is supplied to the gate electrode of the electron gun of the CRT and a negative potential difference is supplied also to at least one electrode in the multi-stage electron lens system. Hence, the residual gas ionized in the vicinity of the emitter electrode is caught and collected by the electrodes of the multistage electron lens system.

DESCRIPTION OF THE PREFERRED EBODIMENTS

The embodiments of the invention will be described with reference to the accompanying drawings.

Figure 1:
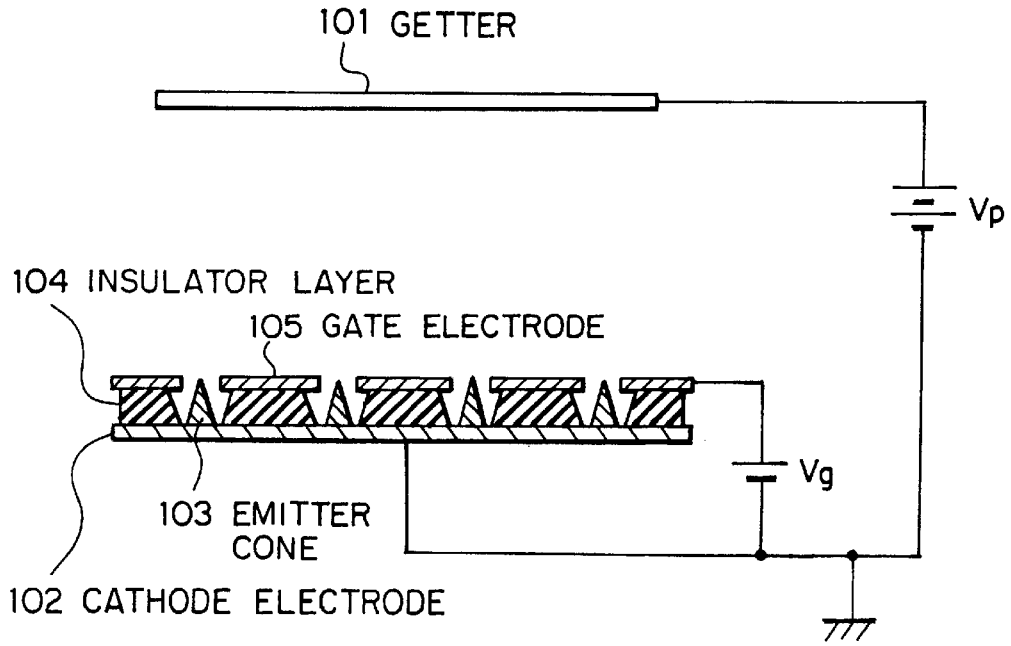
FIG. 1 PRIOR ART
FIG. 1 is a sectional schematic representation illustrating an example of the related art of a micro vacuum pump.
Figure 2:
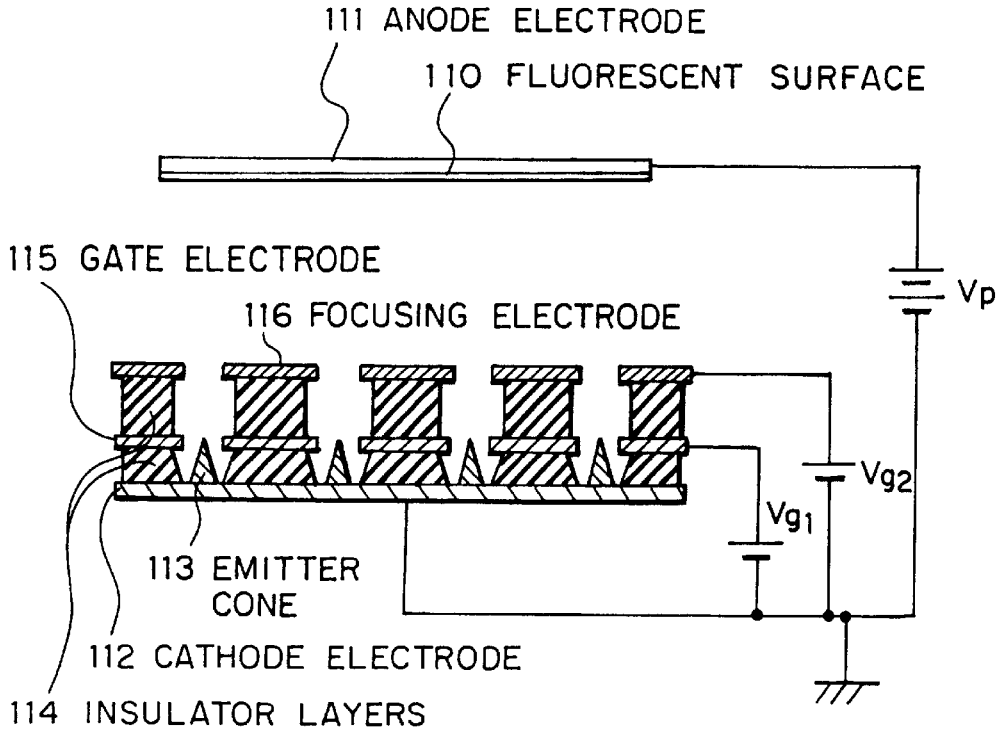
FIG. 2 PRIOR ART
FIG. 2 is a sectional schematic representation illustrating an example different from that shown in FIG. 1.
Figure 3:
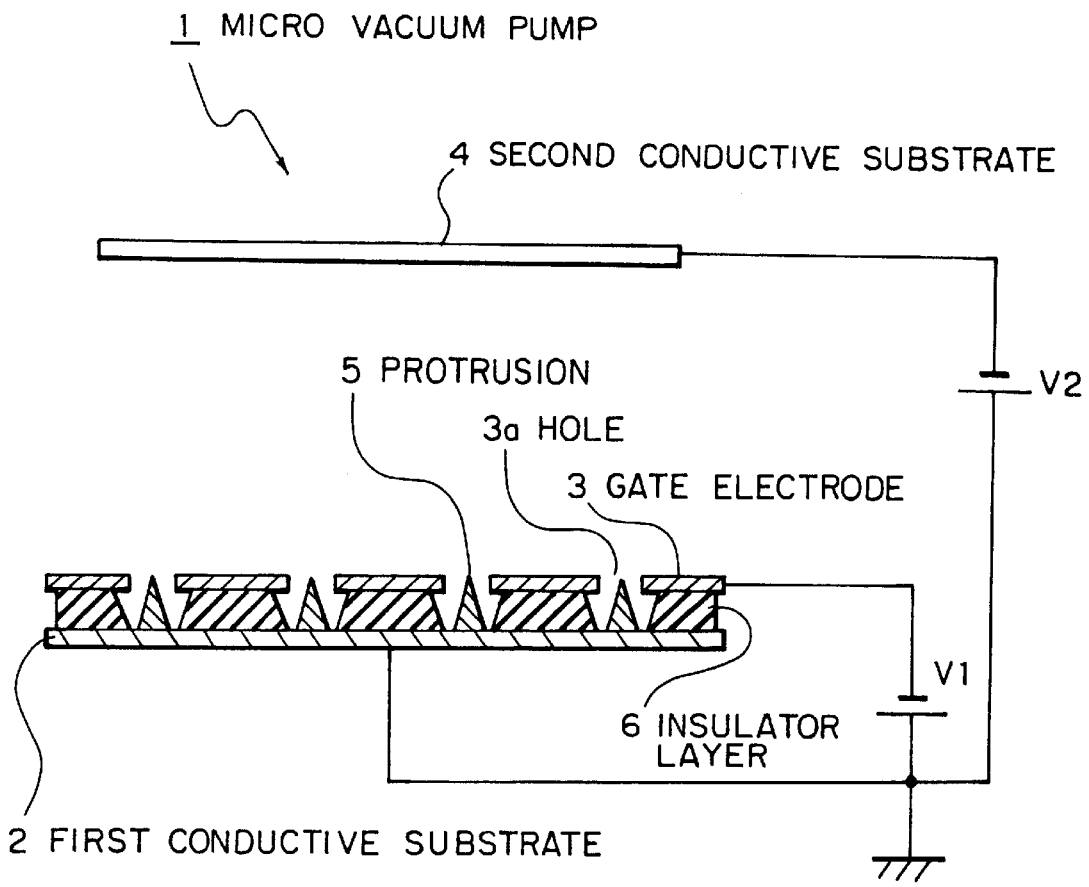
FIG. 3 is a sectional schematic representation illustrating a first embodiment in accordance with the present invention.

FIG. 3 is a sectional schematic representation illustrating a first embodiment in accordance with the present invention. A micro vacuum pump 1 shown in FIG. 3 includes a first conductive substrate 2, a gate electrode 3, and a second conductive substrate 4 as chief constituents, and the micro vacuum pump is disposed in a vacuum chamber.

The present invention is characterized by the following.

The first conductive substrate 2 is a heavily doped N silicon substrate. Provided on the surface of the first conductive substrate 2 facing the second conductive substrate 4 are many (e.g. $10^6$ pieces) micro protrusions 5 composed of a metal having a high melting point such as molybdenum or a semiconductor element such as silicon. The first conductive substrate 2 has the gate electrode 3 mounted via an insulator layer 6 on the surface thereof opposed to the second conductive substrate 4.

The gate electrode 3 is subjected to a negative potential difference V1, relatively to the protrusions 5 or the first conductive substrate 2. The gate electrode 3 is made of a metal such as molybdenum that has a high melting point, and has holes 3*a* that are positioned around the respective protrusions 5 and that expose the apexes of the protrusions 5. The thickness of the gate electrode is set to 0.2 $\mu$m and the diameter of the holes to 0.6 $\mu$m.

The second conductive substrate 4 is subjected to a negative potential difference V2, relatively to the protrusions 5 or the first conductive substrate 2, and disposed with a predetermined interval from the first conductive substrate 2. The second conductive substrate 4 is formed using a metal such as barium, nickel, titanium, or an alloy thereof that provides a getter material.

The micro protrusions 5 are all conically shaped and directed to the second conductive substrate 4. The manufacturing method for the same is described, for example, in "Journal of Applied Physics. Vol. 47 (1976), P5248."

The insulator layer 6 is a silicon oxide film ($SiO_2$) with the thickness of 0.5 $\mu$m.

As described above, the micro vacuum pump having such a constitution ionizes an active gas and a rare gas in the vacuum chamber around the micro protrusions 5 of the first conductive substrate 2 so that the ionized gases are adsorbed by the activated second conductive substrate 4.

Figure 4:
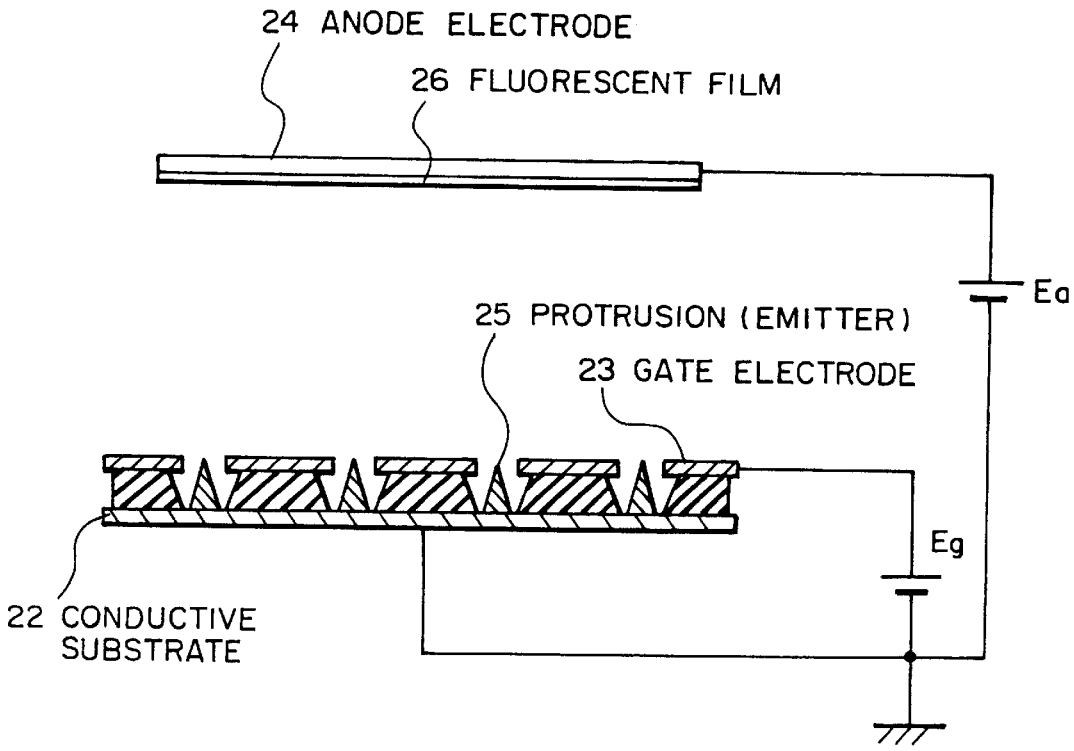
FIG. 4 is a sectional schematic representation illustrating an example of the structure in which a field emission type cold cathode is employed as an electron gun.

Referring now to FIG. 4, a case will be described where the micro protrusions are used as electron emitting sources or emitters, namely, field emission type cold cathodes.

As illustrated, provided on one surface of a conductive substrate 22 are a gate electrode 23 and micro protrusions 25 as in the case shown in FIG. 3. A fluorescent film 26 is formed on a surface of an anode electrode 24 opposed to the gate electrode 23 and the micro protrusions 25 with a predetermined distance provided therebetween. As illustrated, relative to the protrusions 25 serving as the emitter electrodes, a positive potential difference Eg is supplied to the gate electrode 23 and a positive potential difference Ea is supplied to the anode electrode 24. Thus, concentrating the electric field in the protrusions 25 causes electrons to be emitted from the protrusions 25 or emitter electrodes toward the anode electrode 24 and to the fluorescent film 26 due to the Fowler-Nordheim theory.

Referring back to FIG. 3, if the opposite potential from that for the emission of electrons shown in FIG. 3 is applied just like the case shown in FIG. 4, then the protrusions 5 receive electrons. More specifically, when atoms or molecules pass in the vicinity of the micro protrusions 5 where electric field is concentrated, the outermost shell electrons move to the protrusions 5 due to the tunnel effect and a neutral gas is ionized in the electric field to generate positive ions. The positive ions collide upon the second conductive substrate 4 that has a negative potential.

Thus, applying the opposite potential from that for emitting electrons to the gate electrode 3 and the second conductive substrate 4 makes the protrusions 5, where electric field tends to concentrate, serve as ion sources. As a result, the second conductive substrate 4 confines the positive ions inside or the surfaces of the electrodes are activated by the collision of the ions, thus capturing an active residual gas.

The efficiency of ionizing a neutral gas depends primarily on the gate voltage or the intensity of the electric field concentrated at the apex portions of the protrusions 5, and the number of the protrusions 5. Accordingly, the exhaust speed increases as the intensity of the electric field concentrated at the apex portions of the protrusions 5 and the number of the protrusions 5 are increased.

The ionization can be identified by checking the ionic current observed at the second conductive substrate 4. It has been found that the ionic current is generated by supplying a gate voltage equivalent to the negative electric field of $10^8$ V/cm on the apex portions of the protrusions 5, and applying an electric field higher than that further increases the ionizing efficiency. If, however, the intensity of the electric field is excessively increased, field evaporation causes the protrusions 5 themselves to start evaporating. For this reason, it is necessary to supply a gate voltage so that an intensity of applied electric field is $10^8$ V/cm or more but stays lower than the level at which the protrusions 5 start to evaporate.

Further, even when the gate voltage is the same, the intensity of the electric field generated at the protrusions 5 increases as the radius of curvature of the apex portions of the protrusions 5 is decreased. Therefore, the apex portions of the protrusions 5 should be shaped to have as sharp points as possible.

Relative to the first conductive substrate 2, a negative potential difference of 1 kV or more is supplied to the second conductive substrate 4 for the purpose of catching and collecting positive ions. As described on page 435 of "Surface Physical Properties Engineering Handbook" written by Atsushi Koma, published by Maruzen Co., Ltd., the dependence of the sputtering yield of nickel by diverse types of ions on the incident ion energy tends to decrease at 1 kV or more. In that area of 1 kV or more, the ions that have high energy exhibit collision cascade at a depth in a solid, so that the chance of surface atoms being bounced into vacuum is substantially decreased.

Hence, relative to the first conductive substrate 2, supplying a negative potential difference of 1 kV or more to the second conductive substrate 4 causes more ions to go deeply into a solid. And the sputtering of surface electrons activates the surface of the second conductive substrate 4, so that the degree of vacuum in a provided vacuum chamber is increased.

Figure 5:
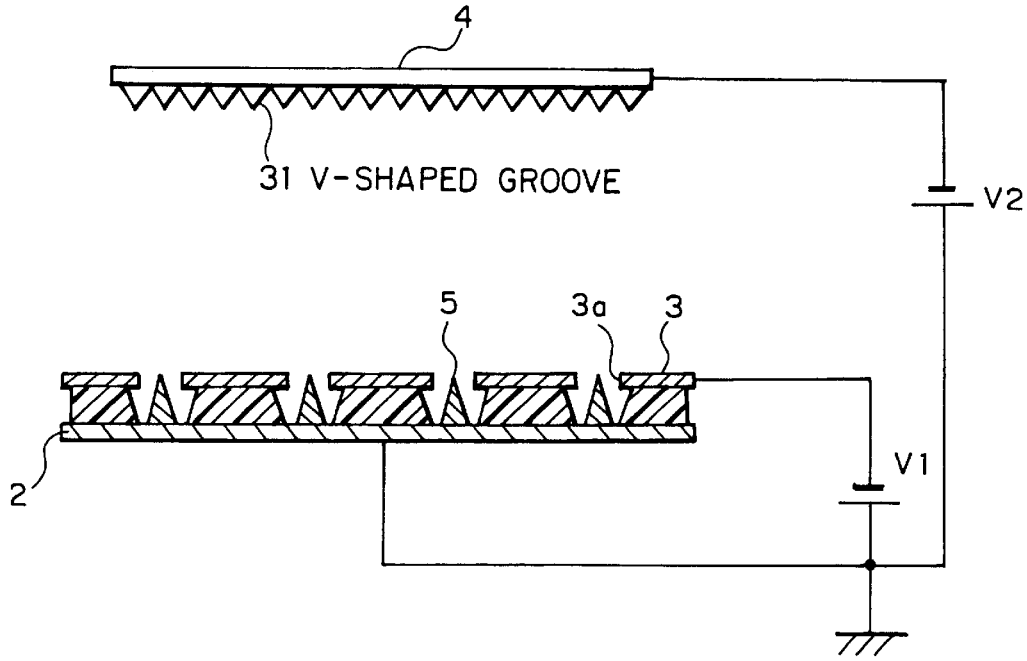
FIG. 5 is a sectional schematic representation illustrating a second embodiment in accordance with the present invention.

Referring now to FIG. 5, a different embodiment than that shown in FIG. 3 will be described.

It is known that the sputtering yield can be generally increased by increasing the incident angle of ions in relation to a surface of a getter rather than by allowing ions to be perpendicularly incident upon the getter. Accordingly, as shown in the drawing, the activation of the surface of the second conductive substrate 4 can be promoted by forming many V-shaped grooves 31 that have V-shaped openings in the surface of the second conductive substrate 4 that faces the gate electrode 3.

In the micro vacuum pump having the composition described above, the exhaust of the provided vacuum chamber is accomplished by colliding and collecting the positive ions of a residual gas produced at the protrusions against the getter to confine them therein, and by adsorbing the positive ions in the activated surface of the getter. This enables highly efficient exhaust of rare gases as well as active gases.

Furthermore, such a micro vacuum pump can be installed in an extremely small space because the ionizing process that is important for exhausting rare gases is implemented in an electric field, so that a magnetic field, which would be necessary for an ionic pump, is not required. The micro vacuum pump that eliminates the need for a magnetic field is ideally used for an image display unit such as a CRT or flat panel display because the trajectory of an electron beam stays unchanged.

Use of the micro vacuum pump for an image display unit including a CRT and a flat panel display does not cause deterioration in the withstand voltage because the getter material does not adhere to the spacer separating a fluorescent screen from an electron emitting section or other places that are irrelevant to the adsorption of gases.

The structure described above makes it possible to provide a thin type vacuum pump having a thickness of about 3 mm even when a gap of 2 mm is allowed by an insulating spacer between the first and second conductive substrates. When the pitch for forming the micro protrusions is set to 1 $\mu$m, the length of one edge of an area where the protrusions are formed can be set to approximately 1 mm. Hence, the micro vacuum pump in accordance with the present invention can be installed in a thin or small apparatus which has a limited installing space.

Figure 6:
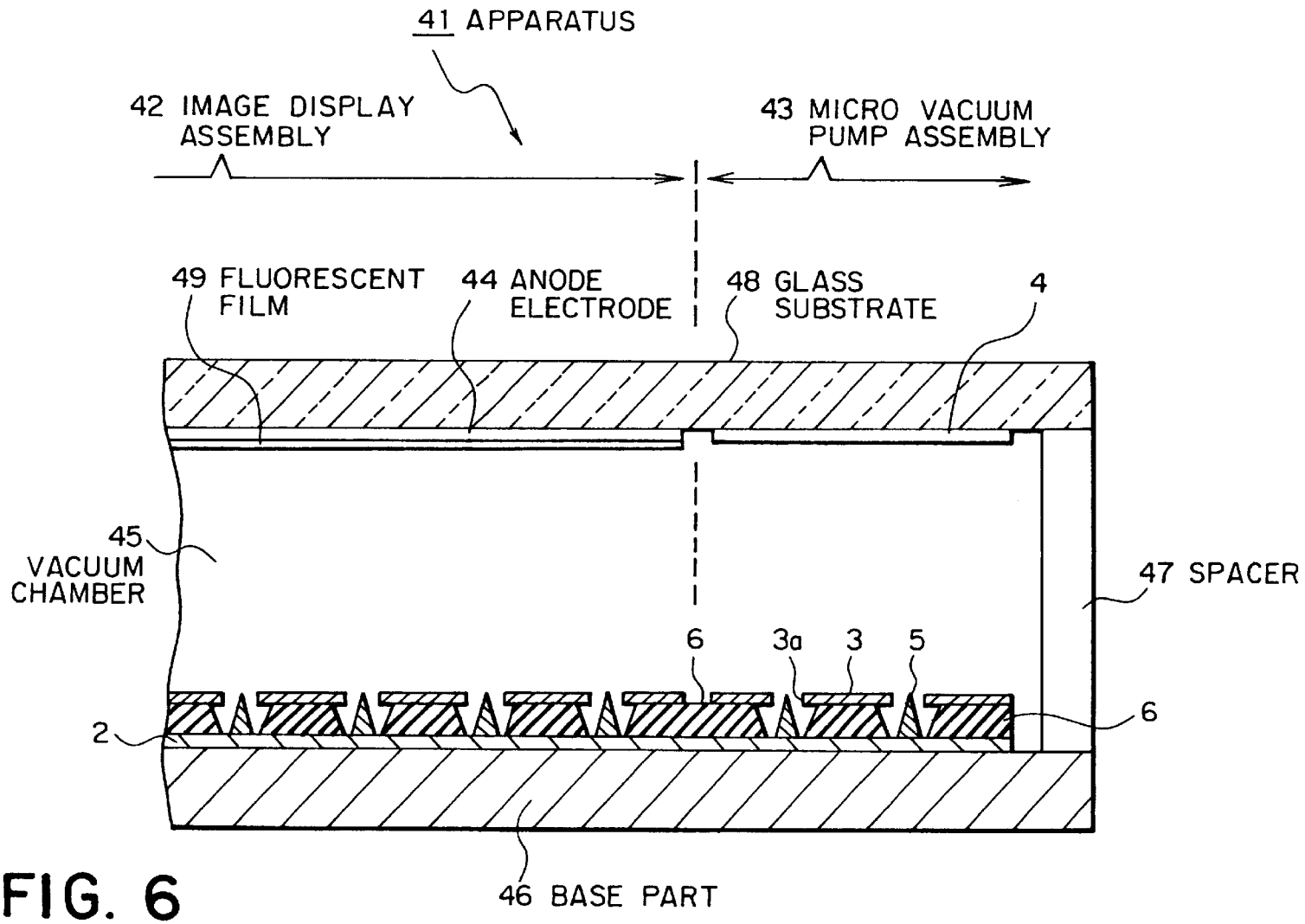
FIG. 6 is a sectional schematic representation illustrating a third embodiment in accordance with the present invention.

Referring now to FIG. 6, an apparatus that incorporates the micro vacuum pump in accordance with the present invention will be described.

An apparatus 41 containing the micro vacuum pump shown in the drawing is a flat panel display, which is a vacuum airtight apparatus. It is assumed that the micro vacuum pump is installed in a vacuum chamber 45. Regarding the incorporated micro vacuum pump, the like constituents as those described with reference to FIG. 3 will be given like reference numerals and the description thereof will be omitted.

The apparatus 41 containing the micro vacuum pump shown in the drawing has a vacuum chamber 45 enclosed by a base part 46, a spacer 47, and a glass substrate 48 that have insulating properties. The vacuum chamber 45 has the base part 46 as the bottom and the glass substrate 48 as the ceiling, and uses the spacer 47 to retain an interval of 500 $\mu$m between the base part 46 and the glass substrate 48. The vacuum chamber 45 is divided into an image display assembly 42 and a micro vacuum pump assembly 43. A first conductive substrate 2 is disposed on the surface of the base part 46 which forms the bottom of the vacuum chamber 45. Many micro protrusions 5 are provided on a surface of the first conductive substrate 2, and a gate electrode 3 is also provided thereon via an insulator layer 6.

In the image display assembly 42, an anode electrode 44 is formed on the glass substrate 48 serving as the ceiling opposed to the gate electrode 3 and the protrusions 5 which operate as emitters, and a fluorescent film 49 is formed on a surface of the anode electrode 44. In this composition, the first conductive substrate 2 is set to a ground potential and, relative to the first conductive substrate 2, a positive potential difference of about 100 V is supplied to the gate electrode 3. As a result, electrons are emitted from the protrusions 5 serving as the emitter electrodes of the first conductive substrate 2. The emitted electrons are radiated to the fluorescent film 49 to which a positive potential difference of about 1 kV is being supplied, relative to the first conductive substrate 2. The fluorescent film 49 emits light in response to the radiated electrons so as to provide an image.

The micro vacuum pump assembly 43 is provided beside or around the image display assembly 42. A second conductive substrate 4 is formed on the glass substrate 48 or the ceiling section opposed to the gate electrode 3 and the protrusions 5. The second conductive substrate 4 is isolated from the anode electrode 44 and the fluorescent film 49. With this arrangement, relative to the first conductive substrate 2, a negative potential difference is supplied to the gate electrode 3 and the second conductive substrate 4 so as to operate the micro vacuum pump as described with reference to FIG. 3.

In the apparatus 41 containing the micro vacuum pump, the interior of the vacuum chamber 45 is exhausted beforehand by another vacuum pump, then the exhaust system is cut off. Relatively to the first conductive substrate 2, a negative potential difference of 150 V is supplied to the gate electrode 3 and a negative potential difference 10 kV is supplied to the second conductive substrate 4. These negative potential differences cause the positive ions of the residual gas, which has been ionized around the apex portions of the protrusions 5, to be captured by the second conductive substrate 4 serving as a getter. Relative to the first conductive substrate 2, applying the negative potential difference of 150 V to the gate electrodes of also the image display assembly also improves the ionizing efficiency.

Referring now to FIG. 7, the position of the micro vacuum pump assembly 43 shown in FIG. 6 when it is provided together with the image display assembly 42 on the same plane will be described.

Figure 7A:
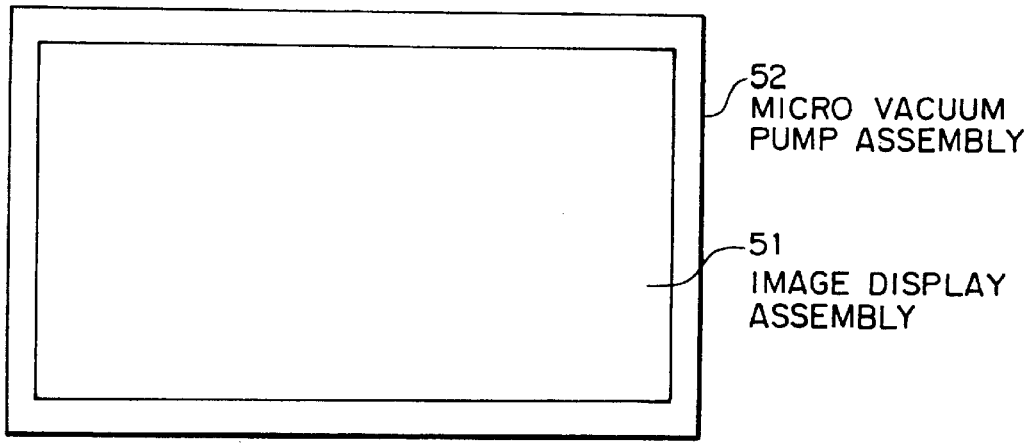
FIG. 7A is a sectional schematic representation illustrating a fourth embodiment related to the layout of a micro vacuum pump assembly shown in FIG. 6.
Figure 7B:
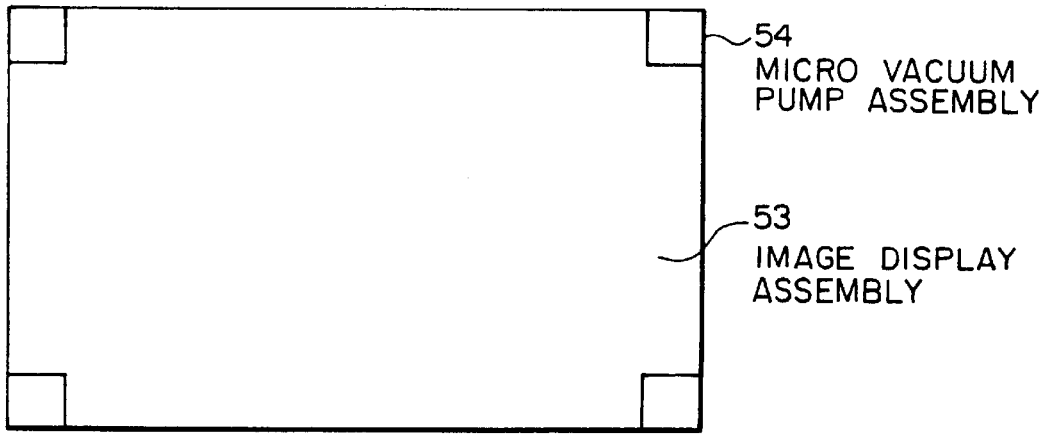
FIG. 7B is a sectional schematic representation illustrating a fifth embodiment related to the layout of the micro vacuum pump assembly shown in FIG. 6.
Figure 7C:
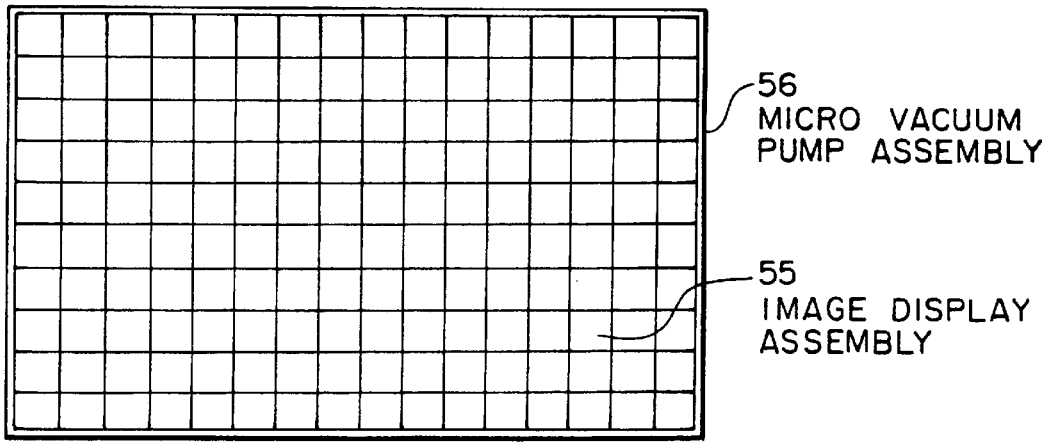
FIG. 7C is a sectional schematic representation illustrating a sixth embodiment related to the layout of the micro vacuum pump assembly shown in FIG. 6.

In FIG. 7A, a micro vacuum pump assembly 52 is disposed so as to surround an image display assembly 51. In FIG. 7B, micro vacuum pump assemblies 54 are disposed on the four corners of an image display assembly 53. In FIG. 7C, a micro vacuum pump assembly 56 is disposed to surround a pixel unit in an image display assembly 55. The pixel unit may include a single pixel or a plurality of pixels.

Figure 8:
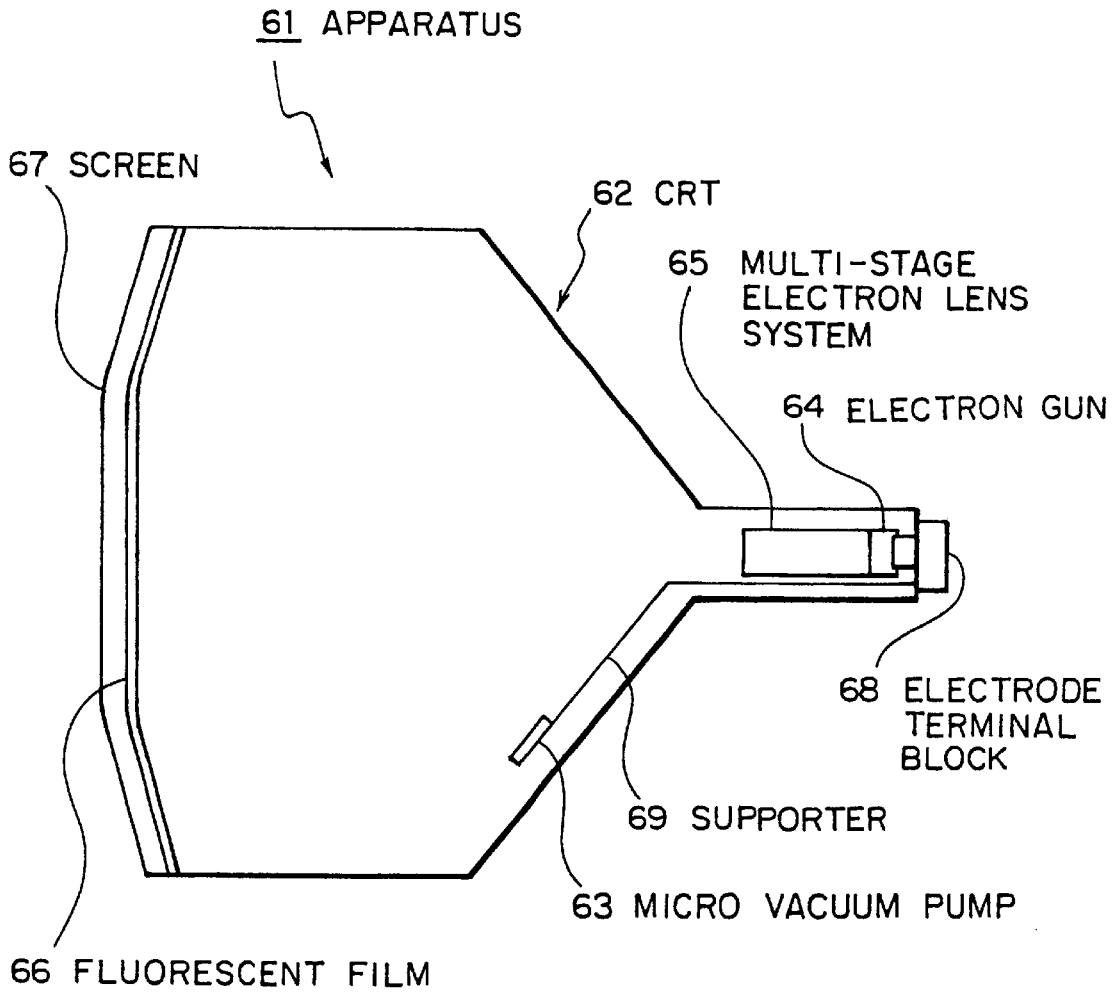
FIG. 8 is a sectional schematic representation illustrating a seventh embodiment related to the layout of the micro vacuum pump assembly in accordance with the present invention.

Referring now to FIG. 8, a description will be given to a case where a CRT 62 is an apparatus 61 containing the vacuum airtight apparatus, wherein a micro vacuum pump 63 is installed.

The CRT 62 illustrated has an electron gun 64, a multistage electron lens system 65, a fluorescent film 66, a screen 67, and an electrode terminal block 68.

The micro vacuum pump 63 is assumed to have the composition described with reference to FIG. 3 and is connected to an electrode terminal block 68 with three wires (not shown). These three wires are secured to a supporter 69 connecting the micro vacuum pump 63 with the electrode terminal block 68 and are connected to the first and second conductive substrates and the gate electrode of the micro vacuum pump 63.

With this arrangement, in the micro vacuum pump 63, a negative potential from the first conductive substrate is supplied to the gate electrode and the second conductive substrate so as to operate the micro vacuum pump as described above. At this time, in the micro vacuum pump 63, relative to the first conductive substrate, a negative potential difference of 150 V is supplied to the gate electrode and a negative potential difference of 15 kV is supplied to the second conductive substrate. These negative potential differences cause the positive ions of the residual gas, which has been ionized around the apex portions of the protrusions, to be captured and collected by the second conductive substrate of getter materials.

If a field emission type cold cathode is employed as the electron gun of the CRT, then the micro vacuum pump and the supporter are unnecessary. In this case, as described above, a potential difference of the opposite polarity from that for emitting electrons is supplied to the field emission type cold cathode. More specifically, relative to the first conductive substrate, two negative potential differences are supplied to the gate electrode and also to at least one of the electrodes in a multi-stage electron lens system, respectively. Thus, the residual gas ionized at the micro protrusions of the field emission type cold cathode can be caught and collected by the electrodes of the multi-stage electron lens system.

The micro vacuum pump assembly or assemblies shown in FIG. 6 through FIG. 8 may be driven at any time, for example, the time before an image is displayed for the first time, or when an apparatus containing the micro vacuum pump assembly or assemblies is driven, or at regular intervals, or at any combination thereof after the apparatus containing the micro vacuum pump assembly or assemblies have been fabricated.

Thus, the micro vacuum pump in accordance with the present invention ionizes an active gas and a rare gas in the vicinity of the protrusions of the first conductive substrate and captures and collects the ionized gases by the activated second conductive substrate. Therefore, the micro vacuum pump in accordance with the invention is able to adsorb not only active gases such as oxygen- and carbon-based gases but also inert gases or rare gases such as argon by the getter material. This makes it possible to enhance the performance of exhausting rare gases and therefore to ensure the quality of the vacuum pump.

Moreover, in the apparatus assembling the micro vacuum pump in accordance with the present invention, driving the micro vacuum pump in a vacuum airtight apparatus such as a CRT or flat panel display enables stable images to be produced and also prevents luminance or service life of the device from deteriorating. Furthermore, an ionized gas is caught and collected by the second conductive substrate, and the ions of the residual gas do not pour down on the emitter electrodes. Therefore, it is possible to prevent damage to the emitter electrodes and to retain stable gettering performance with good repeatability over a long period of time.

What is claimed is:

1. A micro vacuum pump executing a pumping action by ionizing a gas, comprising:

a first conductive substrate;

protrusions attached to said first conductive substrate;

an insulator layer on said first conductive substrate;

a gate electrode on said insulator layer and surrounding said protrusions;

a second conductive substrate spaced apart from said first conductive substrate and opposing said gate electrode at a predetermined distance;

a gas ion generating means for generating a positive gas ion from a gas molecule located within a space defined between said first conductive substrate and said second conductive substrate, said gas ion generating means including an electric source providing a positive potential to said first conductive substrate to cause field electrolytic dissociation of gases in a vicinity of said protrusions resulting in the creation of positively charged gas ions, the freeing of electrons from the gases, and the capture of the freed electrons by said protrusions; and an adsorbing means for adsorbing said gas ion on the surface of said second conductive substrate, said adsorbing means including an electric source providing a negative potential to said second conductive substrate, the negative potential selected to be lower than the positive potential of said first conductive substrate and to attract and absorb the positively charged gas ions on the surface of said second conductive substrate.

2. The micro vacuum pump of claim 1, wherein said means for generating a gas ion includes said plurality of protrusions being exposed to said second conductive substrate by corresponding holes through said insulator layer and said gate electrode, said plurality of protrusions having an electric potential applied relative to said gate electrode so as to provide an electric field in the vicinity of an apex of each of said plurality of protrusions sufficient to ionize said gas molecule.

3. The micro vacuum pump of claim 1, wherein said means for adsorbing said gas ion on a surface of said second conductive substrate comprises said second conductive substrate being made of a getter material.

4. The micro vacuum pump of claim 3, wherein said getter material comprises one of the group consisting of barium, nickel, and titanium.

5. The micro vacuum pump of claim 1, wherein said surface of said second conductive substrate comprises a plurality of V-shaped grooves opposing said gate electrode.

6. The micro vacuum pump of claim 1, wherein said electric field in the vicinity of an apex of each of said plurality of protrusions has an electric field strength of at least 108 V/cm.

7. The micro vacuum pump of claim 2, wherein said second conductive substrate has a negative voltage potential of 1 kV applied thereto with respect to said plurality of protrusions.

8. The micro vacuum pump of claim 1, wherein a space defined between said first conductive substrate and said second conductive substrate is a vacuum airtight space.

9. The micro vacuum pump of claim 8, wherein said vacuum airtight space comprises a CRT, and wherein each of said gate electrode, said first conductive substrate, and said second conductive substrate are electrically connected to an electrode terminal block at a neck of said CRT.

10. The micro vacuum pump of claim 1, wherein said gas molecule is an inert gas.

11. A CRT, comprising:

a vacuum airtight space;

an electron gun having a field emission type cold cathode within said vacuum airtight space;

a means for generating a gas ion from a residual gas molecule located within said vacuum airtight space, said means including plural protrusions surrounded by a gate electrode layer and an electric source for providing a positive potential to the plural protrusions, the positive potential being sufficiently positive relative to a gate electrode potential to positively ionize gases in a vicinity of the protrusions, free electrons from the gases, and cause the protrusions to adsorb the freed electrons; and a multi-stage electron lens system, said multi-stage electron lens system having electrodes to catch and collect said gas ion, wherein a negative voltage potential with respect to an emitter electrode of said electron gun is supplied to a gate electrode of said electron gun and to one of said electrodes of said multi-stage electron lens system.

12. A combination flat panel display and micro vacuum pump device, the device comprising:

a vacuum chamber;

an image display assembly contained within said vacuum chamber; and a micro vacuum pump assembly contained within said vacuum chamber adjacent to said image display assembly, said micro vacuum pump assembly designed to execute pump action by ionizing a gas and including a first conductive substrate, an insulator layer on said first conductive substrate, a gate electrode on said insulator layer, a second conductive substrate spaced apart from said first conductive substrate and opposing said gate electrode, a plurality of protrusions electrically connected to said first conductive substrate and exposed to said second conductive substrate through corresponding holes in said gate electrode and said insulator layer, said protrusions arranged for generating a positive gas ion from a gas molecule located within a space adjacent said protrusions, said protrusions being connected to an electric source providing a positive potential to said protrusions to cause ion dissociation of gases for the creation of positively charged gas ions, the freeing of electrons from the gases, and the capture of the freed electrons by said protrusions, said second conductive substrate for adsorbing a gas ion generated by an electric field established between said gate electrode and said plurality of protrusions, said second conductive substrate being connected to an electric source providing a negative potential to said second conductive substrate, the negative potential selected to be lower than the positive potential of said protrusions and to attract and absorb the positively charged gas ions on a surface of said second conductive substrate, said electric field ionizing a residual gas molecule within said vacuum chamber when the combination device is in a vacuum pumping mode.

13. The combination flat panel display and micro vacuum pump device of claim 12, wherein said image display assembly is surrounded at a peripheral region by said second conductive substrate.

14. The combination flat panel display and micro vacuum pump device of claim 12, wherein said second conductive substrate is disposed at a corner of said image display assembly.

15. The combination flat panel display and micro vacuum pump device of claim 13, wherein said image display assembly comprises a pixel unit.

16. The combination flat panel display and micro vacuum pump device of claim 12, wherein said image display assembly comprises:

an anode electrode spaced apart from said first conductive substrate; and a fluorescent film on said anode electrode opposing said gate electrode, said anode electrode and said fluorescent film being electrically isolated from said second conductive substrate, wherein a portion of said plurality of protrusions located in said image display assembly are exposed to said fluorescent film by a subset of said corresponding holes through said insulator layer and said gate electrode.

* * * * *